US005094018A

United States Patent [19]

Theurer et al.

[11] Patent Number: 5,094,018

[45] Date of Patent: * Mar. 10, 1992

[54] MOBILE MACHINE FOR RECEIVING AND DISTRIBUTING TRACK BALLAST

[75] Inventors: Josef Theurer, Vienna; Friedrich Oellerer, Linz, both of Austria

[73] Assignee: Franz Plasser Bahnbaumaschinen-Industriegesellschaft M.B.H., Vienna, Austria

[ * ] Notice: The portion of the term of this patent subsequent to Oct. 1, 2008 has been disclaimed.

[21] Appl. No.: 599,047

[22] Filed: Oct. 17, 1990

[30] Foreign Application Priority Data

Oct. 31, 1989 [AT] Austria ..... 2511/89

[51] Int. Cl.[5] ..... E02F 5/22

[52] U.S. Cl. ..... 37/104; 171/16; 124/2; 414/528

[58] Field of Search ..... 104/2, 279; 171/16; 37/104, 105; 414/528, 502, 503, 505, 523; 198/311

[56] References Cited

U.S. PATENT DOCUMENTS

| | | | |
|---|---|---|---|
| 2,748,720 | 6/1956 | Kling | 37/104 |
| 3,034,236 | 5/1962 | Pyke | 37/105 |
| 3,605,297 | 9/1971 | Kershaw | 37/105 |
| 3,612,184 | 10/1971 | Plasser et al. | 171/16 |
| 3,726,382 | 4/1973 | Gelfren et al. | 37/104 |
| 3,877,160 | 4/1975 | Plasser et al. | 37/104 |
| 4,160,418 | 7/1979 | Theurer | 104/2 |
| 4,207,820 | 6/1980 | Cicin-Sain | 104/2 |
| 4,370,819 | 2/1983 | Ingram | 37/104 |
| 4,425,969 | 1/1984 | Naggar . | |
| 4,468,042 | 9/1984 | Coy | 37/104 |
| 4,538,687 | 9/1985 | Theurer et al. | 104/2 |
| 4,556,112 | 12/1985 | Theurer et al. | 171/16 |
| 4,568,237 | 2/1986 | Krause et al. | 414/528 |
| 4,576,538 | 3/1986 | Theurer et al. | 414/339 |
| 4,682,428 | 7/1987 | Cicin-Sain | 171/16 |
| 4,706,395 | 11/1987 | Cicin-Sain | 171/16 |
| 4,707,935 | 11/1987 | Cicin-Sain | 171/16 |
| 4,770,104 | 9/1988 | Theurer | 37/104 |
| 4,809,617 | 3/1989 | Theurer et al. | 414/339 |
| 4,835,897 | 6/1989 | Theurer | 37/104 |
| 4,925,356 | 5/1990 | Snead et al. | 414/505 |

FOREIGN PATENT DOCUMENTS

| | | | |
|---|---|---|---|
| 1709506 | 12/1977 | Fed. Rep. of Germany | 37/104 |
| 2194982 | 3/1988 | United Kingdom | 104/2 |

*Primary Examiner*—Randolph A. Reese
*Assistant Examiner*—Spencer Warnick
*Attorney, Agent, or Firm*—Collard, Roe & Galgano

[57] ABSTRACT

A mobile ballast receiving and distributing machine comprises a machine frame supported on a railroad track by undercarriages for mobility in an operating direction, a ballast conveying device arranged on the machine frame to receive ballast and to convey the received ballast to a discharge end of the device, and a power-driven ballast storage silo arranged on the machine frame to receive the conveyed ballast from the discharge end of the ballast conveying device. The silo has a ballast discharge opening and a ballast conveyor band extending in the direction of the longitudinal extension of the machine frame and forming a bottom support for the ballast received from the ballast conveying device discharge end, the ballast conveyor band having an end discharging the ballast into the ballast discharge opening.

11 Claims, 1 Drawing Sheet

MOBILE MACHINE FOR RECEIVING AND DISTRIBUTING TRACK BALLAST

BACKGROUND OF THE INVENTION

1. Field of the Invention

The present invention relates to a mobile machine for receiving and distributing ballast supporting a railroad track, which comprises a machine frame having a longitudinal extension parallel to the track and supported on the track by undercarriages for mobility in an operating direction, a ballast conveying device arranged on the machine frame to receive ballast and to convey the received ballast to a discharge end of the device, and a ballast storage silo arranged on the machine frame to receive the conveyed ballast from the discharge end of the ballast conveying device and having ballast discharge opening means. The conveying device may comprise a rotary ballast broom and an obliquely ascending ballast conveyor adjacent thereto, the ballast conveyor having an input arranged to receive ballast swept up by the rotary ballast broom and an output forming the discharge end of the device.

2. Description of the Prior Art

U.S. Pat. No. 3,877,160, dated Apr. 15, 1975, discloses a ballast regulator comprising a ballast plow arrangement mounted on a machine frame between two undercarriages supporting respective ends of the machine frame for mobility on a railroad track. The plow arrangement comprises a vertically adjustable center plow with plowshares pivotal for adjustment about a vertical axis to enable the ballast to be redistributed in any desired manner over the entire width of the ballast bed in a single pass of the machine. Laterally and vertically adjustable shoulder plowshares are associated with the center plow at each side of the machine frame for suitably shaping the ballast bed shoulders. A ballast storage silo is arranged on the machine frame between the rear undercarriage and the center plow, the silo having hydraulically operable ballast discharge opening means at an underside thereof so that ballast stored in the silo may be discharged onto the ballast bed in any track section which has too little ballast. A ballast conveying device comprising two rotary ballast brooms and an obliquely ascending ballast conveying band adjacent thereto, the ballast conveying band having an input end arranged to receive ballast swept up by the rotary ballast brooms and an output end forming the discharge end of the device, is mounted behind the ballast plow arrangement for conveying ballast to the silo. While such a ballast plow enables the amount of ballast along the track to be equalized, the small storage capacity of the silo leads to relatively short track sections having either too little or too much ballast after a certain number of such track sections have been plowed.

U.S. Pat. No. 4,425,969, dated Jan. 17, 1984, discloses a rail-mounted ballast regulator machine with a vertically adjustable center plow mounted between the undercarriages and a rotary ballast broom arrangement at the rear end of the machine. An obliquely ascending ballast conveyor band receives ballast swept up by the broom and conveys the ballast to another conveyor band extending substanstially horizontally towards a front end of the machine and being pivotal about a vertical axis, the front end of the other conveyor band being adjustable to discharge the swept up and conveyed ballast into a preceding ballast transport car which may have a ballast storage hopper. While this machine makes it possible to store excess ballast in relatively large amounts, only relatively little ballast is stored for filling track sections with too little ballast.

SUMMARY OF THE INVENTION

It is a primary object of this invention to provide a mobile machine of the first-described type with enhanced ballast storage capabilities and a relatively simple structure enabling the stored ballast to be distributed to any section of the ballast bed requiring additional ballast.

The above and other objects are accomplished according to the invention with a ballast storage silo arranged on the machine frame to receive the conveyed ballast from the discharge end of the ballast conveying device, the silo having ballast discharge opening means, a ballast conveyor band extending in the direction of the longitudinal extension of the machine frame and forming a bottom support for the ballast received from the ballast conveying device discharge end, the ballast conveyor band having an output end discharging the ballast into the ballast discharge opening means, and a drive for actuating the ballast conveyor band.

Such a ballast storage silo makes it possible to store considerably more ballast than has been possible with known ballast storage silos, and no retrofitting is required to enable the ballast supporting bottom ballast conveyor band in the silo to discharge stored ballast through the discharge opening means in any track section where the ballast bed requires more ballast. In this manner, the ballast bed of a relatively long track section can be properly regulated and provided with a uniform ballast amount along the entire track section in a single pass. Previous technology required under these circumstances to transport additional amounts of ballast in ballast transport cars to long track sections having too little ballast while excess ballast in other track sections had to be stored on the track shoulders. Since the ballast conveyor band displaces the stored ballast in the silo in the direction of the longitudinal extension of the machine frame while the discharge opening means of the silo remains stationary, the silo may be quite long but relatively low to afford the operator of the machine unobstructed visibility over the silo while such a silo will have a considerable storage capacity. Filling as well as discharge of the silo can be effected without any structural machine changes.

The ballast storage silo may have a bottom and the ballast conveyor band then forms a false bottom and is arranged above the bottom, or the ballast conveyor band may form the bottom of the ballast storage silo. The ballast conveying device preferably comprises a rotary ballast broom and an obliquely ascending ballast conveyor adjacent thereto, the ballast conveyor having an input arranged to receive ballast swept up by the rotary ballast broom and an output forming the discharge of the device.

According to one preferred feature of the present invention, the ballast conveyor band extends along the entire length of the ballast storage silo and has a rear end below the ballast conveyor output and opposite the ballast conveyor band output end, the ballast conveyor output projecting into the silo. This enables the side walls of the silo to project vertically with respect to the plane defined by the machine frame and thus maximally increases the storage capacity of the silo.

In accordance with another preferred feature, the ballast storage silo is elongated and extends between two of said undercarriages supporting the machine frame on the track, and the machine further comprises a ballast plow arrangement mounted on the machine frame below the ballast storage silo, the ballast plow arrangement comprising center and shoulder plowshares. This provides a compact ballast plow with a ballast storage silo of enhanced capacity and yet makes it possible to afford an operator in a cab to have free visibility over the silo when he drives the machine between operating sites and to enable him carefully to observe the amount of ballast stored in the open silo.

Preferably, the ballast discharge opening means is arranged ahead of the ballast plow arrangement, in the operating direction, and an elevated operator's cab is arranged on the machine frame above the ballast discharge opening means. In this way, the operator in the cab has an unobstructed view of the track section behind the machine during its operation as well as when he drives the machine between operating sites. Since the ballast discharge opening means is arranged below the cab, the operator can also at least partially observe the discharge of the stored ballast onto the ballast bed.

In one preferred embodiment of this invention, the mobile machine further comprises a mobile ballast plow preceding the machine frame in the operating direction, a forward end of the machine frame being pivotally coupled to the ballast plow and a rear end of the machine frame adjacent the ballast conveying device being supported on the track by one of the undercarriages whereby the machine frame forms a trailer of the ballast plow, and an operator's cab arranged on a rear end of the ballast plow adjacent the trailer. A ballast plow of this type makes it possible to install a silo of particularly large storage capacity on the trailer and, if desired, to uncouple the trailer from the plow. Existing ballast plows may readily be retrofitted with such a trailer.

According to another preferred embodiment, the mobile machine further comprises a mobile ballast plow preceding the machine frame in the operating direction, a forward end of the machine frame being coupled to the ballast plow and the machine frame being supported on the track by two of the undercarriages whereby the machine frame forms a trailer of the ballast plow, the ballast conveying device and storage silo being mounted on the machine frame between the two undercarriages. This arrangement enables a silo of very large storage capacity to be used, and the support of the silo-carrying machine frame on two undercarriages reduces the axle load on each undercarriage.

In a further preferred embodiment, the machine frame comprises two carrier beams extending parallel to each other in the direction of the longitudinal extension and the ballast storage silo having two side walls fastened to the carrier beams. This arrangement enables the silo to be hung between the carrier beams at a relatively low level, with the bottom relatively close to the ballast bed and with relatively high side walls, so that the storage capacity of the silo will be increased without obstructing the view of an operator in a cab above the silo. In this case, the ballast discharge opening means is preferably vertically adjustable by drive means for vertically adjusting the ballast discharge means. This enables the ballast discharge opening means to be raised when the machine is moved between operating sites.

Finally, the silo may comprise two ballast conveyor bands extending successively in the direction of the longitudinal extension of the machine frame in a common plane, a respective drive actuating each of the ballast conveyor bands, the ballast discharging ends of the ballast conveyor bands being adjacent each other and the ballast discharge opening means being arranged to receive the discharged ballast from the ballast discharging ends. The use of two ballast conveyor bands will be particularly useful in very long silos since this arrangement will cut the conveyor path for fully emptying the silo in half. In addition, such an arrangement will symmetrically distribute the weight of the stored ballast in the silo.

BRIEF DESCRIPTION OF THE DRAWING

The above and other objects, advantages and features of the present invention will become more apparent from the following description of certain now preferred embodiments thereof, taken in conjunction with the accompanying, somewhat diagrammatic drawing wherein.

DETAILED DESCRIPTION OF THE PREFERRED EMBODIMENTS

Figure 1:
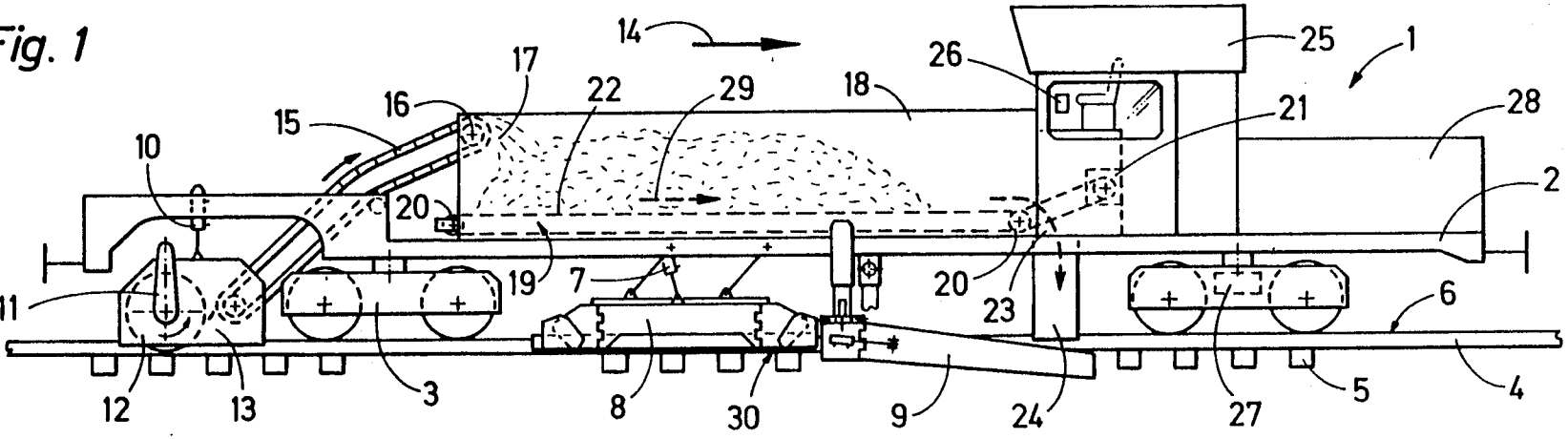
FIG. 1 is a side elevational view of one embodiment of a mobile machine according to the invention and incorporating a ballast plow arrangement, the bottom of the illustrated ballast storage silo being formed by a ballast conveyor band extending along its entire length.
Figure 2:
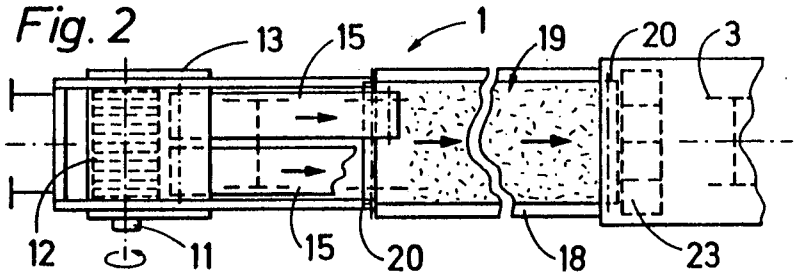
FIG. 2 is a fragmentary top view of the machine of FIG. 1, at a smaller scale.

Referring now to the drawing and first to FIGS. 1 and 2, there is shown mobile machine 1 for receiving and distributing ballast supporting railroad track 6 consisting of rails 4 fastened to ties 5. The machine comprises machine frame 2 having a longitudinal extension parallel to track 6 and supported on the track by swivel trucks 3 for mobility in an operating direction indicated by arrow 14. A ballast conveying device is arranged on machine frame 2 to receive ballast and to convey the received ballast to a discharge end of the device. The illustrated ballast conveying device comprises rotary ballast broom 12 and two obliquely ascending ballast conveyors 15 adjacent thereto, the ballast conveyors having an input arranged to receive ballast swept up by rotary ballast broom 12 and output 17 forming the discharge end of the device. The rotary ballast broom is vertically adjustably connected by hydraulic drive 10 to a cantilever arm extending rearwardly of rear undercarriage 3 and is rotatable by drive 11. The inputs of ballast conveyors 15 precede the ballast broom in the operating direction and drives 16 ar provided for operating the ballast conveying bands. Ballast storage silo 18 is arranged on machine frame 2 to receive the conveyed ballast from discharge end 17 of the ballast conveying device, the silo having ballast discharge opening means constituted by chutes 24.

According to the invention, ballast conveyor band 19 extends in the direction of the longitudinal extension o machine frame 2 and forms a bottom support for the ballast received from ballast conveying device discharge end 17, the ballast conveyor band having outlet end 23 discharging the ballast into ballast discharge opening means 24, and drive 21 actuates the ballast conveyor band. In the illustrated embodiment, the ballast conveyor band forms the bottom of silo 18. The endless ballast conveyor band is trained over rear and front pulleys 20, 20, a transmission belt connecting drive 21 to front pulley 20 to drive upper course 22 of the conveyor belt in the direction indicated by arrow 29 towards discharge chutes 24. As shown, ballast conveyor band 19 extends along the entire length of ballast storage silo 18 and has a rear end below ballast conveying device discharge end 17 and opposite ballast conveyor band discharging end 23, the ballast conveyor output output into the silo. Ballast storage silo 18 is elongated and extends between the two undercarriages 3, 3 supporting machine frame 2 on track 6.

In the embodiment of FIG. 1, mobile machine 1 further comprises a ballast plow arrangement mounted on machine frame 2 below ballast storage silo 18, the ballast plow arrangement comprising center plowshare 8 vertically adjustably connected to machine frame 2 by hydraulic drives 7 and vertically and transversely adjustable shoulder plowshares 9. The shoulder plowshares may be pivoted about a vertical axis to enclose a desired acute angle with track 6 or extend parallel thereto.

As shown, ballast discharge opening means 24 is arranged ahead of the ballast plow arrangement, in the operating direction, and an elevated operator's cab 25 is arranged on machine frame 2 above the ballast discharge opening means. A central control panel 26 in cab 25 enables an operator in the cab to operate the machine. Power plant 28 provides energy to the various drives, including drive 27 for propelling mobile machine 1 along the track.

In operation of mobile machine 1, as shown in FIG. 1, ballast broom arrangement 13 is lowered and broom 12 is rotated counter-clockwise to sweep excess ballast onto obliquely ascending conveyors 15, 15 which throw the elevated ballast at discharge end 17 into silo 18 where it falls onto the rear end of ballast conveyor band 19. As soon as the ballast at this conveyor band end has reached the level of the upper edges of the side walls of the silo, drive 21 is actuated for a short time to move the ballast in the direction of arrow 29 towards ballast discharge opening means 24, the drive actuation being discontinued as soon as there is enough room at the conveyor band rear end to accommodate another load of excess ballast. This intermittent conveyance of the ballast on upper course 22 of conveyor band 19 enables silo 18 to be filled with ballast. While excess ballast is thus stored, ballast regulation by ballast plow arrangement 30 comprised of center and shoulder plowshares 8, 9 continues unhindered as the machine advances continuously in the operating direction indicated by arrow 14. When the machine reaches a track section containing insufficient ballast for proper regulation and shaping of the ballast bed, ballast discharge openings 24 ar opened to distribute stored ballast over any area containing an insufficient amount of ballast. If silo 18 has not been completely filled, i.e. the ballast on conveyor band 19 has not reached openings 24, drive 21 is actuated to move the ballast on the conveyor band to the openings so that the ballast falls therethrough to the underlying areas of the ballast bed. The amount of ballast dispensed through openings 24 is controllable by hydraulically operable shutters at the outlet ends of the openings, as is well known. Since ballast discharge openings 24 are arranged ahead of plow arrangement 30 in the operating direction, it may be used by the plow arrangement for the proper shaping of the ballast bed.

Figure 3:
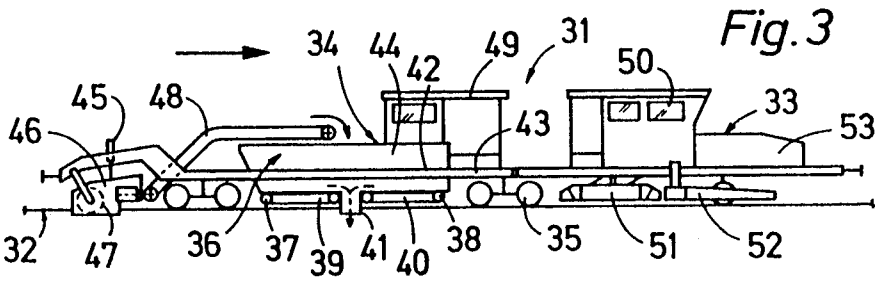
FIGS. 3 to 5 illustrate three further embodiments in side elevational views.

In the embodiment of FIG. 3, ballast regulator 31 for track 32 further comprises mobile ballast plow 33 preceding machine frame 43 in the operating direction, a forward end of the machine frame being coupled to the ballast plow and respective ends of machine frame being supported on track 32 by undercarriages 35 whereby machine frame 43 forms trailer 34 of ballast plow 33. Elongated ballast storage silo 36 has two side walls 44 and machine frame 43 is comprised of two parallel carrier beams 42 to which the silo side walls are fastened, the silo hanging low between the carrier beams. The bottom of the ballast storage silo is formed by two ballast conveyor bands 39, 40 extending successively in the direction of the longitudinal extension of the machine frame in a common plane, a respective drive 37, 38 actuating each ballast conveyor band 39, 40, the ballast discharging ends of the ballast conveyor bands being adjacent each other and the ballast discharge opening means 41 being arranged to receive the discharged ballast from the ballast discharging ends. When one or both ballast conveyor bands are driven to convey ballast stored thereon to discharge openings 41, the outlet ends of the openings are closed. They are opened when the machine reaches a track section requiring more ballast, as herein-above described, whereupon drives 37, 38 are driven in opposite directions to move the ballast stored on the conveyor bands towards the discharge openings. Ballast distribution from silo 36 may be stopped at any time by closing the outlet ends of openings 41 and stopping drives 37, 38. An operator in cab 49 has a full rearward view to be able to observe all operations.

A cantilevered support projecting rearwarly of rear undercarriage 35 of machine frame 43 vertically adjustable carries ballast broom arrangement 46 comprised of rotary broom 47 connected to the support by hydraulic drive 45 and obliquely ascending ballast conveyor 48. The ballast plow carries power plant 53 which supplies energy to the machine drive and other drives of the machine, and operator's cab 50 is arranged on a rear end of the ballast plow adjacent trailer 34, which carries its own operator's cab 49. The ballast plow 33 also carries a ballast plow arrangement including center and shoulder plowshares 51, 52 mounted on the frame of the ballast plow. Machine frame 43 comprises two carrier beams 42 extending parallel to each other in the direction of the longitudinal extension and ballast storage silo 36 has two side walls 44 fastened to the carrier beams.

Figure 4:
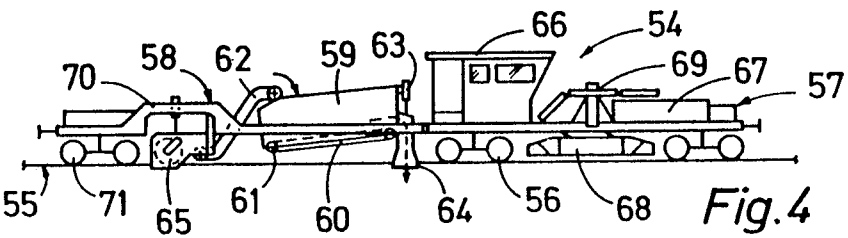

In the embodiment of FIG. 4, ballast regulator 54 for track 55 further comprises mobile ballast plow 57 preceding machine frame 58 in the operating direction, a forward end of the machine frame being pivotally coupled to the ballast plow and a rear end of the machine frame adjacent the ballast conveying device comprised of rotary broom 65 and obliquely ascending ballast conveyor 62 being supported on track 55 by one of the undercarriages 71 whereby machine frame 58 forms a trailer of ballast plow 57. The ballast plow carries power plant 67 and operator's cab 66 arranged on a rear end of the ballast plow adjacent trailer 58. The opposite ends of ballast plow 57 are supported by undercarriages on track 55 and a ballast plow arrangement including center and shoulder plowshares 68, 69 are mounted on the frame of the ballast plow between the undercarriages. Machine frame 58 comprises two carrier beams 70 extending parallel to each other in the direction of the longitudinal extension and ballast storage silo 59 has two side walls fastened to the carrier beams. Ballast conveyor band 60 in silo 59 is actuated by drive 61 and ballast discharge openings 64 are vertically adjustable by hydraulic drives 63.

Figure 5:
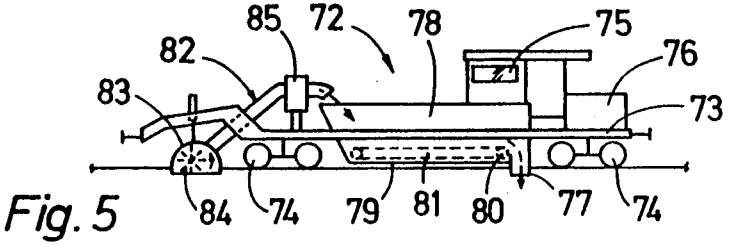

Mobile ballast receiving and distributing machine 72 illustrated in FIG. 5 comprises elongated machine frame 73 supported at its opposite ends by swivel trucks 74, 74 and is propelled along the track by drive 76. Operator's cab 75 is mounted on a forward end of the machine frame and overlooks ballast storage silo 78 whose forward end has ballast discharge opening means 77. The silo has a bottom 79 and a false bottom comprised of ballast conveyor band 81 actuated by drive 80. The rear end of machine frame 78 carries ballast receiving arrangement 82 comprised of a vertically adjustable ballast broom arrangement comprising rotary broom 84 and a ballast suction arrangement 85 receiving ballast swept up by the broom and having a discharge end delivering the ballast into the silo. Machine 72 can be used independently or can be coupled to a ballast plow.

It will be obvious to one of ordinary skill in the art that the mobile machine of the present invention may be equipped with other embodiments of ballast receiving devices than the ones illustrated herein. For example, the ballast receiving device supplying excess ballast to the ballast storage silo may comprise a ballast bed planing shield and a bucket elevator lifting and conveying the ballast dammed by the shield to the silo. Furthermore, the bottom ballast conveyor band in the silo may be replaced by an endless conveyor chain running above the silo bottom and equipped with ballast entrainment elements extending tranversely to the conveyor chains. In this case, the ballast would be supported on the silo bottom and conveyed towards the discharge opening means by the entrainment elements of the conveyor chain.

What is claimed is:

1. A mobile machine for receiving, distributing and plowing ballast supporting a railroad track, which comprises (a) a machine frame having a longitudinal extension parallel to the track and supported on the track by undercarriages for mobility in an operating direction, (b) a ballast conveying device arranged on the machine frame to receive ballast and to convey the received ballast to a discharge end of the device, (c) an elongated ballast storage silo arranged on the machine frame between two of said undercarriages to receive the conveyed ballast from the discharge end of the ballast conveying device, the silo having (1) ballast discharge opening means arranged to distribute the received ballast to the track, (2) a ballast conveyor band extending in the direction of the longitudinal extension of the machine frame and forming a bottom support for the ballast received from the ballast conveying device discharge end, the ballast conveyor band having an output end discharging the ballast into the ballast discharge opening means, and (3) a drive for actuating the ballast conveyor band, (d) a ballast plow arrangement mounted on the machine frame below the ballast storage silo and behind the ballast discharge opening means in the operating direction, and (e) an elevated operator's cab arranged on the machine frame above the ballast discharge opening means and providing an unobstructed view over and beyond the ballast conveying device and the ballast storage silo.

2. The mobile machine of claim 1, wherein the ballast storage silo has a bottom and the ballast conveyor band is arranged above the bottom.

3. The mobile machine of claim 1, wherein the ballast conveyor band forms the bottom of the ballast storage silo.

4. The mobile machine of claim 1, wherein the ballast conveying device comprises a rotary ballast broom and an obliquely ascending ballast conveyor adjacent thereto, the ballast conveyor band having an input arranged to receive ballast swept up by the rotary ballast broom and an output forming the discharge end of the device.

5. The mobile machine of claim 4, wherein the ballast conveyor band extends along the entire length of the ballast storage silo and has a rear end below the ballast conveyor output and opposite the ballast conveyor band output end, the ballast conveyor output projecting into the silo.

6. The mobile machine of claim 1, wherein the ballast plow arrangement comprises center and shoulder plowshares.

7. The mobile machine of claim 1, further comprising a mobile ballast plow preceding the machine frame in the operating direction, a forward end of the machine frame being pivotally coupled to the ballast plow and a rear end of the machine frame adjacent the ballast conveying device being supported on the track by one of the undercarriages whereby the machine frame forms a trailer of the ballast plow, and an operator's cab arranged on a rear end of the ballast plow adjacent the trailer.

8. The mobile machine of claim 1, further comprising a mobile ballast plow preceding the machine frame in the operating direction, a forward end of the machine frame being coupled to the ballast plow and the machine frame being supported on the track by two of the undercarriages whereby the machine frame forms a trailer of the ballast plow, the ballast conveying device and storage silo being mounted on the machine frame between the two undercarriages.

9. The mobile machine of claim 1, wherein the machine frame comprises two carrier beams extending parallel to each other in the direction of the longitudinal extension and the ballast storage silo has two side walls fastened to the carrier beams.

10. The mobile machine of claim 1, wherein the ballast discharge opening means is vertically adjustable, and comprises drive means for vertically adjusting the ballast discharge opening meals.

11. The mobile machine of claim 1, comprising two of said ballast conveyor bands extending successively in the direction of the longitudinal extension of the machine frame in a common plane, a respective one of said drives actuating each of the ballast conveyor bands, the ballast discharging output ends of the ballast conveyor bands being adjacent each other and the ballast discharge opening means being arranged to receive discharged ballast from the ballast discharging output ends.

* * * * *